US012270598B2

(12) United States Patent
Cha et al.

(10) Patent No.: US 12,270,598 B2
(45) Date of Patent: Apr. 8, 2025

(54) REFRIGERATOR AND METHOD OF CONTROLLING THE SAME

(71) Applicant: LG ELECTRONICS INC., Seoul (KR)

(72) Inventors: Kyunghun Cha, Seoul (KR); Namsoo Cho, Seoul (KR); Sunam Chae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 341 days.

(21) Appl. No.: 17/775,399

(22) PCT Filed: Nov. 3, 2020

(86) PCT No.: PCT/KR2020/015190
§ 371 (c)(1),
(2) Date: May 9, 2022

(87) PCT Pub. No.: WO2021/101127
PCT Pub. Date: May 27, 2021

(65) Prior Publication Data

US 2022/0397337 A1 Dec. 15, 2022

(30) Foreign Application Priority Data

Nov. 19, 2019 (KR) ..... 10-2019-0148473

(51) Int. Cl.
*F25D 29/00* (2006.01)
*F25D 17/06* (2006.01)
*F25D 17/08* (2006.01)

(52) U.S. Cl.
CPC ..... *F25D 29/00* (2013.01); *F25D 17/062* (2013.01); *F25D 17/08* (2013.01);
(Continued)

(58) Field of Classification Search
CPC ..... F25D 2600/06; F25D 2600/02; F25D 2700/12; F25B 2600/0251
See application file for complete search history.

(56) References Cited

U.S. PATENT DOCUMENTS 4,662,185 A * 5/1987 Kobayashi ..... G05D 23/1912 62/229
5,345,778 A * 9/1994 Roberts ..... A47F 3/0447 62/256

(Continued)

FOREIGN PATENT DOCUMENTS

CN 102589232 7/2012
CN 106066115 11/2016

(Continued)

OTHER PUBLICATIONS

Chinese Office Action dated Apr. 15, 2023 issued in Application No. 202080075469.5.

(Continued)

*Primary Examiner* — Filip Zec
(74) *Attorney, Agent, or Firm* — KED & Associates LLP

(57) ABSTRACT

According to the present disclosure, a method for controlling a refrigerator includes operating a cooling device at a previously-determined output for cooling a storage space; measuring, by a temperature sensor, a temperature of the storage space in unit times; determining a representative temperature of the storage space based on the temperature measured by the temperature sensor, and determining whether the determined representative temperature of the storage space falls within a convergence temperature range, when an output change time is reached after the output of the cooling device is previously determined; maintaining the output of the cooling device or determining the output of the cooling device according to one of a plurality of methods including a first method and a second method when the (Continued)

representative temperature of the storage space falls within the convergence temperature range, and determining the output of the cooling device according to the second method when the representative temperature of the storage space is out of the convergence temperature range; and operating the cooling device at the determined output.

19 Claims, 7 Drawing Sheets

(52) U.S. Cl.
CPC ..... *F25D 2600/02* (2013.01); *F25D 2600/06* (2013.01); *F25D 2700/12* (2013.01)

(56) References Cited

U.S. PATENT DOCUMENTS

| | | | | |
|---|---|---|---|---|
| 7,730,732 | B2 * | 6/2010 | Kaga | F25D 29/00 236/1 C |
| 9,303,907 | B2 * | 4/2016 | Kawano | F25B 45/00 |
| 11,493,267 | B2 * | 11/2022 | Ahn | F25D 17/065 |
| 11,549,736 | B2 * | 1/2023 | Chung | F25D 17/06 |
| 2007/0163291 | A1 | 7/2007 | Kim et al. | |
| 2012/0023980 | A1 * | 2/2012 | Lee | F25B 5/02 62/132 |
| 2015/0330703 | A1 * | 11/2015 | Satou | G05B 15/02 700/300 |
| 2020/0158423 | A1 | 5/2020 | Ahn et al. | |

FOREIGN PATENT DOCUMENTS

| | | | | |
|---|---|---|---|---|
| CN | 107169596 | A | 9/2017 | |
| CN | 107560127 | | 1/2018 | |
| CN | 108885054 | | 11/2018 | |
| JP | 2001-004260 | | 1/2001 | |
| KR | 10-0725495 | | 6/2007 | |
| KR | 10-2011-0027562 | | 3/2011 | |
| KR | 10-2011-0030772 | | 3/2011 | |
| KR | 10-2018-0061753 | | 6/2018 | |
| KR | 10-2018-0072146 | | 6/2018 | |
| KR | 10-2018-0135398 | | 12/2018 | |
| KR | 10-2019-0005033 | | 1/2019 | |
| WO | WO-2019009642 | A1 * | 1/2019 | F25D 11/00 |

OTHER PUBLICATIONS

Korean Notice of Allowance dated Nov. 21, 2023 issued in Application No. 202080075469.5.

International Search Report and Written Opinion dated Feb. 10, 2021 issued in Application No. PCT/KR2020/015190.

Chinese Office Action dated Sep. 1, 2023 issued in Application 202080075469.5.

Extended European Search Report dated Oct. 26, 2023 issued in Application 20890329.4.

* cited by examiner

【FIG. 1】
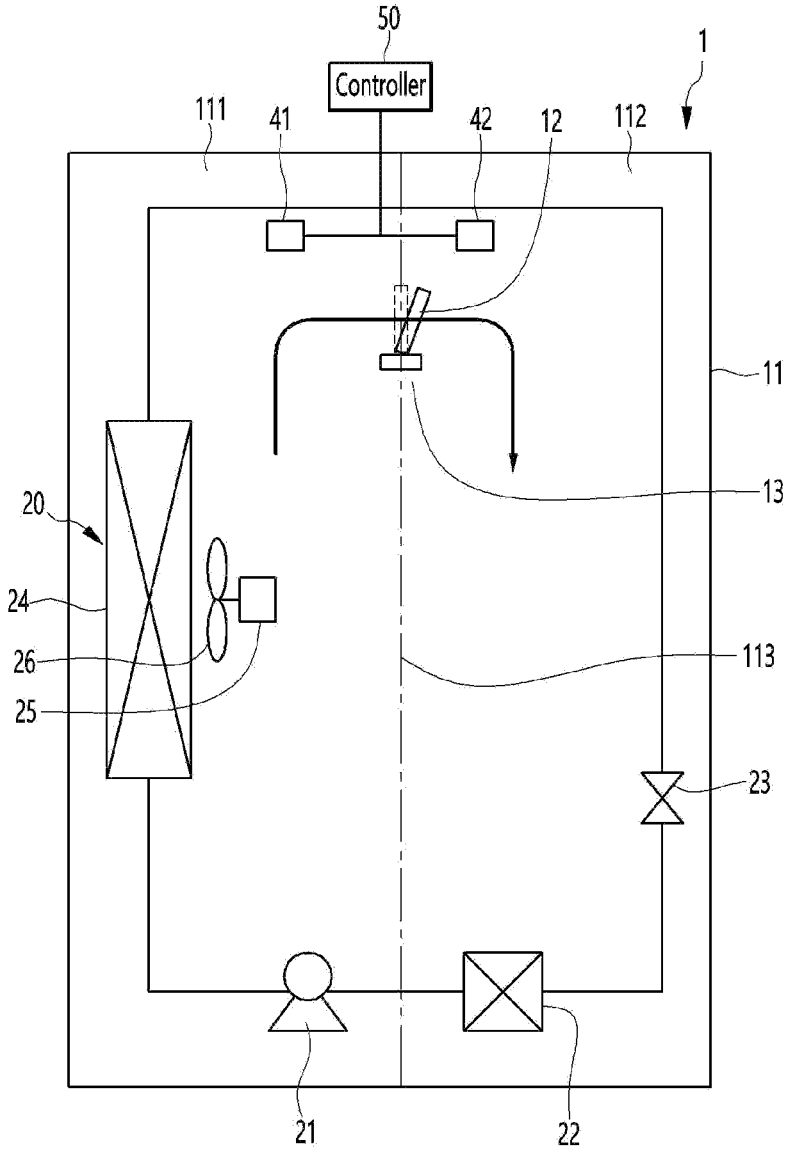

【FIG. 2】
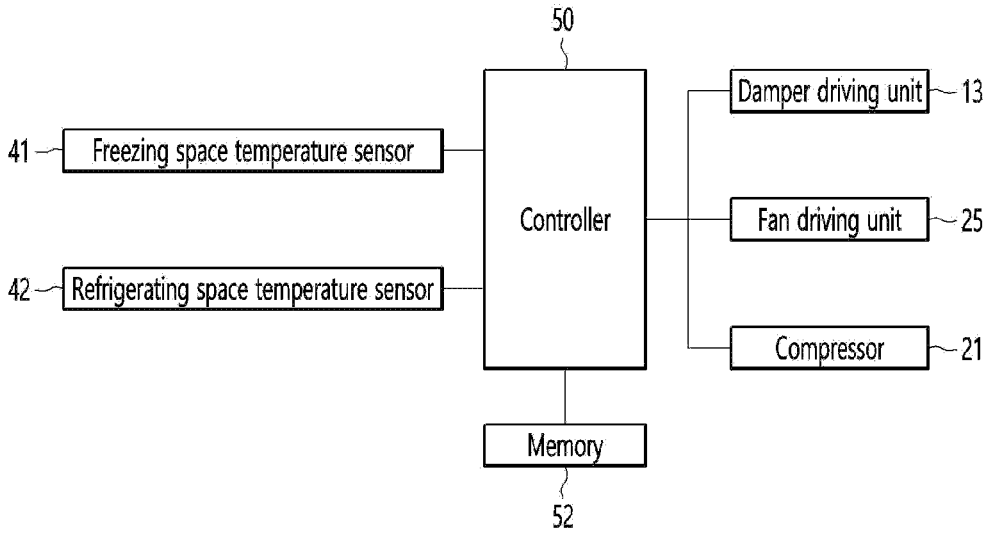

【FIG. 3】
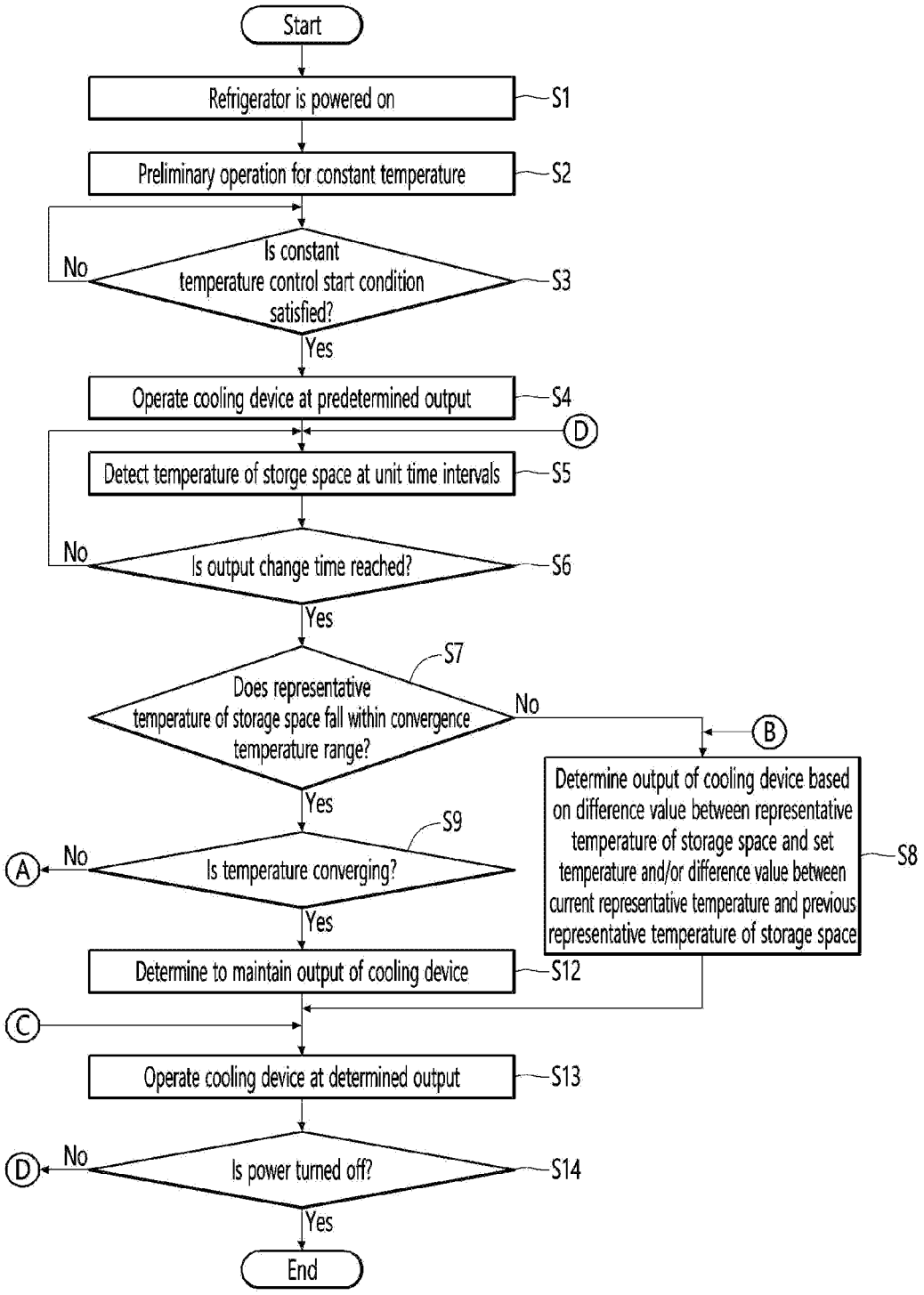

【FIG. 4】
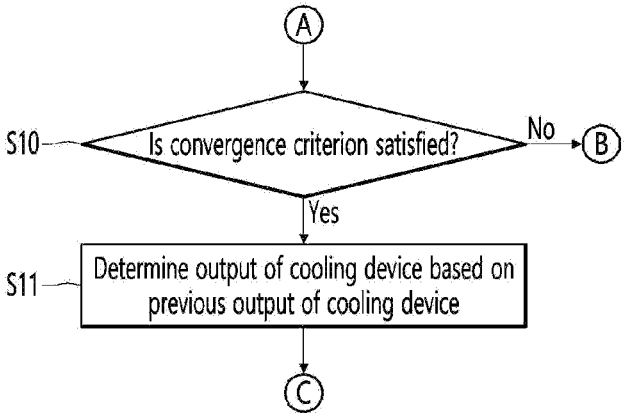

【FIG. 5】
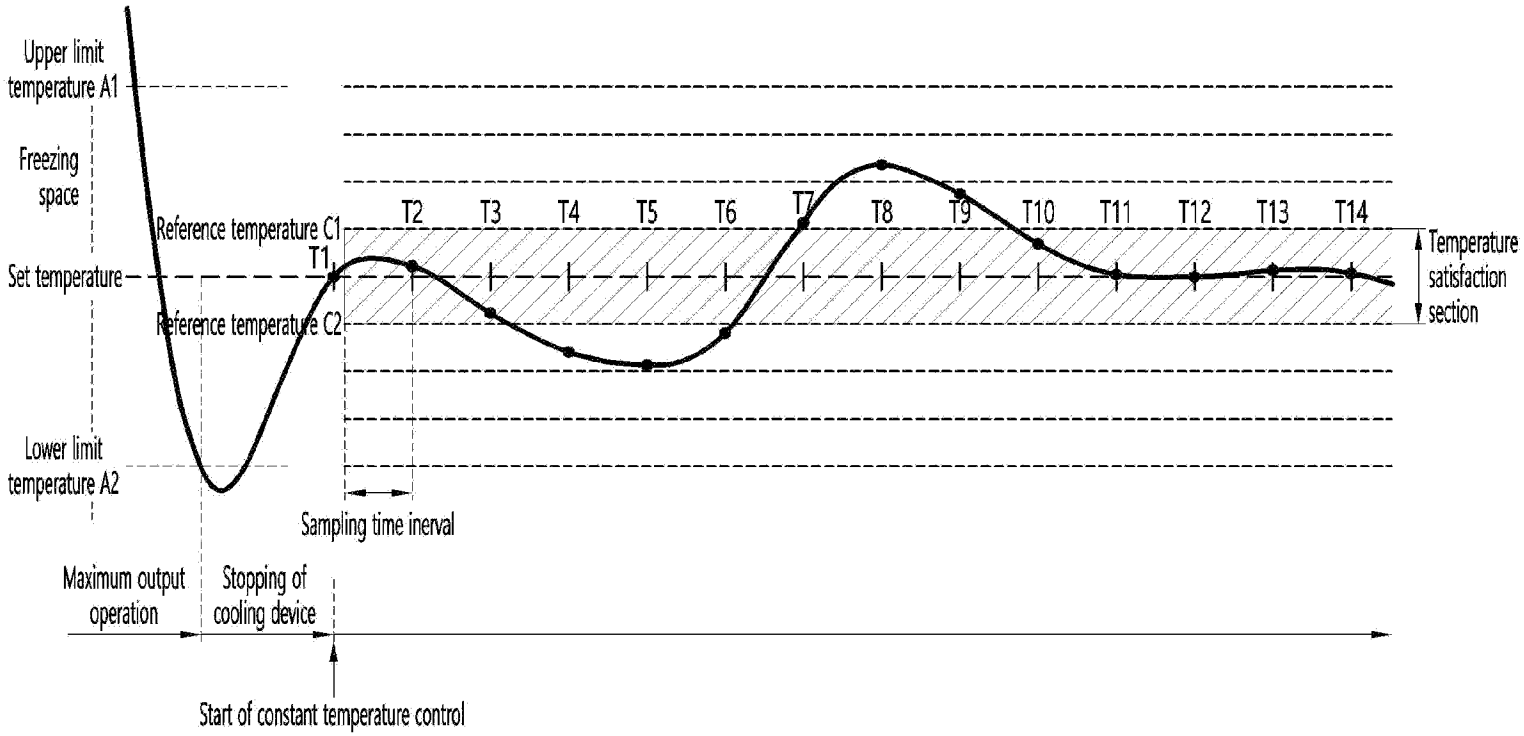

【FIG. 6】
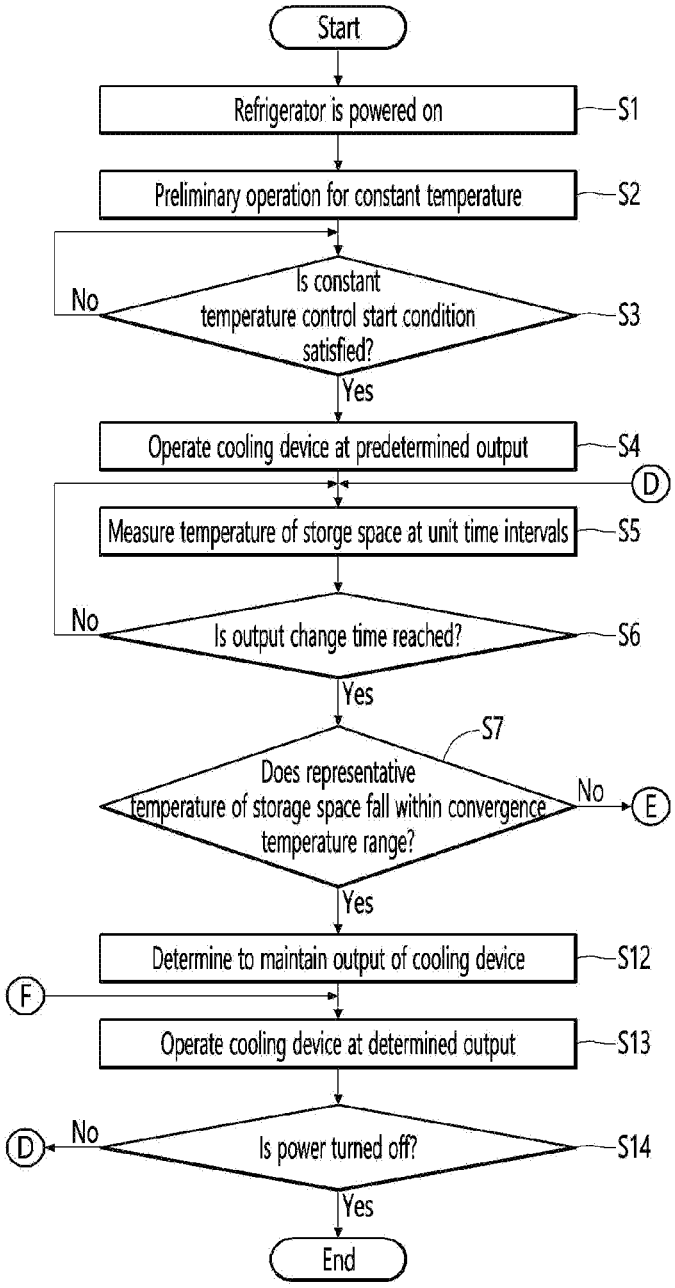

【FIG. 7】
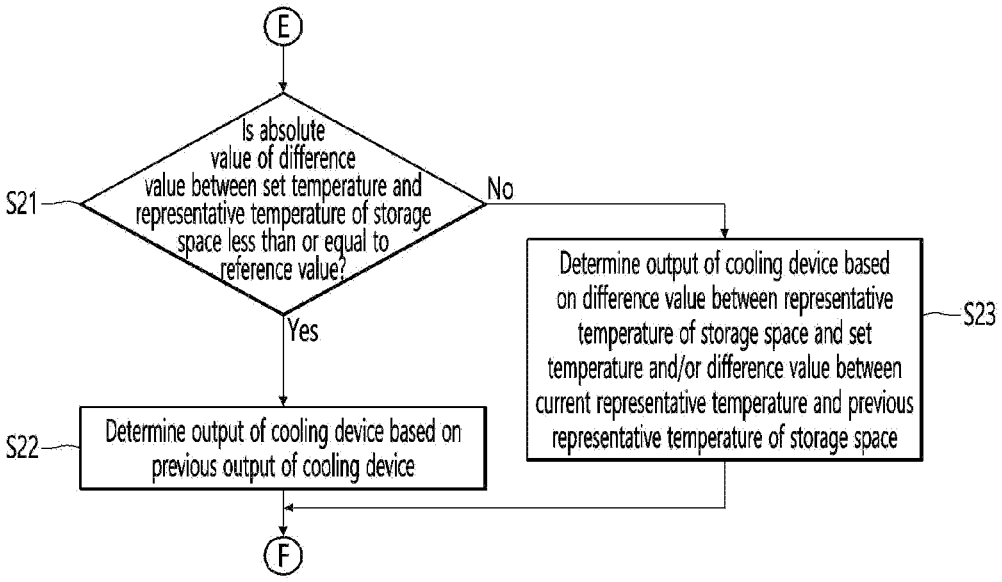

REFRIGERATOR AND METHOD OF CONTROLLING THE SAME

CROSS-REFERENCE TO RELATED PATENT APPLICATIONS

This application is a U.S. National Stage Application under 35 U.S.C. § 371 of PCT Application No. PCT/KR2020/015190, filed Nov. 3, 2020, which claims priority to Korean Patent Application No. 10-2019-0148473, filed Nov. 19, 2019, whose entire disclosures are hereby incorporated by reference.

TECHNICAL FIELD

The present discloser relates to a refrigerator and a method of controlling the same.

BACKGROUND ART

A refrigerator is a home appliance to store foods at a lower temperature and spaces of the refrigerator need to be constantly maintained at a lower temperature.

In order to maintain the freshness of food stored in a storage space, a variation width of a temperature of the storage space should be small.

A prior art document, Korean Patent Application Publication No. 10-2018-0061753 discloses a method for controlling a refrigerator.

The method for controlling the refrigerator includes the steps of: when a temperature of a storage space is detected and the temperature of the storage space is greater than or equal to a first reference temperature, operating the cooling device at a cooling output; when the detected temperature of the storage space is less than or equal to a second reference temperature lower than the first reference temperature, operating the cooling device at a delay output that is an output lower than the cooling output; and determining, by a controller, the cooling output or the delay output of the cooling device according to the temperature of the storage space while the cooling device is operated as the delay output, and operating the cooling device at the determined cooling output or delay output.

According to the prior art document, since the cooling output is determined by the average output of a previous cooling output and the delay output, for example, the magnitude of a temperature difference between the temperature of the storage space and the reference temperature is not reflected, and a variation in the output is large, making it difficult to finely adjust the output.

DISCLOSURE OF INVENTION

Technical Problem

The present embodiment provides a refrigerator and a method for controlling the same, capable of maintaining a temperature of a storage space at a constant temperature to improve the freshness of a stored object.

Alternatively or additionally, the present embodiment provides a refrigerator and a method for controlling the same, in which a variation width in temperature can be reduced during a temperature control operation for maintaining a temperature of a storage space at a constant temperature.

Alternatively or additionally, the present embodiment provides a refrigerator and a method for controlling the same, in which a variation in a temperature can be reduced during a temperature control operation for maintaining a temperature of a storage space at a constant temperature.

Solution to Problem

According to an aspect, a method for controlling a refrigerator may include operating a cooling device at a previously-determined output for cooling a storage space; measuring a temperature of the storage space in unit times through a temperature sensor; determining a representative temperature of the storage space based on the temperature measured through the temperature sensor, and determining whether the determined representative temperature of the storage space falls within a convergence temperature range, when an output change time is reached after the output of the cooling device is previously determined; maintaining the output of the cooling device or determining the output of the cooling device according to one of a plurality of methods including a first method and a second method when the representative temperature of the storage space falls within the convergence temperature range. The method may further include operating the cooling device at the determined output.

The method may further include determining the output of the cooling device according to the second method when the representative temperature of the storage space is out of the convergence temperature range. The method may further include operating the cooling device at the determined output.

The representative temperature of the storage space may be a temperature of the storage space at a time when the output change time is reached, an average temperature of the storage space before the output change time is reached, an average temperature of the storage space in some of all of sections before the output change time is reached, an average temperature of a highest temperature and a lowest temperature in all of the sections before the output change time is reached, or an average temperature of a highest temperature and a lowest temperature in some of all of the sections before the output change time.

The method may further include determining whether the representative temperature of the storage space is converging when the representative temperature of the storage space falls within the convergence temperature range, and maintaining the output of the cooling device when the representative temperature of the storage space is converging.

The method may further include determining whether the representative temperature of the storage space satisfies a convergence criterion when the representative temperature of the storage room is not converging; The method may further include determining the output of the cooling device according to the first method when the representative temperature of the storage space satisfies the convergence criterion; The method may further include determining the output of the cooling device according to the second method when the representative temperature of the storage space does not satisfy the convergence criterion.

The case where the representative temperature of the storage space is converging may include one or more of a first case where a time for which the representative temperature of the storage space is continuously maintained within the convergence temperature range is greater than or equal to a first reference time, a second case where a number of times the representative temperature of the storage space has fallen within the convergence temperature range is greater than or equal to a first reference number N when determining whether the representative temperature of the storage space falls within the convergence temperature range at each output change time, a third case where an accumulated time for which the representative temperature of the storage space is continuously maintained within the convergence temperature range is greater than or equal to a second reference time, or a fourth case where a number of times the representative temperature of the storage space has reached a set temperature of the storage space is greater than or equal to a second reference number M.

The case in which the representative temperature of the storage space satisfies the convergence criterion may include a case where a time for which the representative temperature of the storage space is continuously maintained within the convergence temperature range is less than the first reference time and greater than or equal to a third reference time shorter than the first reference time, a case where a number of times the representative temperature of the storage space has fallen within the convergence temperature range is less than the first reference number (N) and greater than or equal to a third reference number (X) less than the first reference number (N) when determining whether the representative temperature of the storage space falls within the convergence temperature range at each output change time, a case where the time for which the representative temperature of the storage space is continuously maintained within the convergence temperature range is less than the second reference time and greater than or equal to a fourth reference time shorter than the second reference time, and a case where the number of times the representative temperature of the storage space has reached the set temperature is less than the second reference number (M) and greater than or equal to a fourth reference number (Y).

The first method may be a method of determining the output of the cooling device based on a previous output of the cooling device.

The method may further include determining a sum (x a) of a maximum value and a minimum value of the output of the cooling device as the output of the cooling device, at a time when the representative temperature of the storage space is maintained within the convergent temperature range.

The second method may be a method of determining the output of the cooling device based on one or more of a first factor which is a difference value between the representative temperature of the storage space and the set temperature, and a second factor, which is a difference value between a current representative temperature and a previous representative temperature of the storage space.

The convergence temperature range may be a range between a first reference temperature higher than a set temperature of the storage space and a second reference temperature lower than the set temperature of the storage space.

The method may further include determining the output of the cooling device at a maximum output when the representative temperature of the storage space is higher than or equal to an upper limit temperature higher than the first reference temperature. The method may further include determining the output of the cooling device at a minimum output when the representative temperature of the storage space is lower than or equal to a lower limit temperature lower than the second reference temperature.

The cooling device may be one or more of a compressor, a fan driving unit, and a damper that opens and closes a duct.

According to another aspect, a method for controlling a refrigerator may include operating a cooling device at a previously-determined output for cooling a storage space; measuring a temperature of the storage space in unit times through a temperature sensor; determining a representative temperature of the storage space based on the temperature measured through the temperature sensor, and determining whether the determined representative temperature of the storage space falls within a convergence temperature range, when an output change time is reached after the output of the cooling device is previously determined; maintaining the output of the cooling device or determining the output of the cooling device according to one of a plurality of methods including a first method and a second method when the representative temperature of the storage space falls within a convergence temperature range. The method may further include operating the cooling device at the determined output.

The method may further include determining the output of the cooling device according to one of a plurality of methods based on a magnitude of a difference value between the representative temperature of the storage space and the set temperature of the storage space. The method may further include operating the cooling device at the determined output.

The method may further include determining the output of the cooling device according to a first method of determining the output of the cooling device based on a previous output of the cooling device when the difference value between the representative temperature of the storage space and the set temperature of the storage space is less than or equal to a reference value.

The method may further include determining the output of the cooling device according to a first method of determining the output of the cooling device based on one or more of a first factor which is a difference value between the representative temperature of the storage space and the set temperature, and a second factor, which is a difference value between a current representative temperature and a previous representative temperature of the storage space when the difference value between the representative temperature of the storage space and the set temperature of the storage space is greater than a reference value.

Further, according to another aspect, a refrigerator may include a cabinet having a storage space; a temperature sensor configured to detect a temperature of the storage space; a cooling device configured to operate to cool the storage space; and a controller configured to control the cooling device.

The controller may operate the cooling device at a previously-determined output, determine a representative temperature of the storage space based on the temperature measured by the temperature sensor when an output change time is reached in operating the cooling device, determine whether the determined representative temperature of the storage space falls within a convergence temperature range, maintain the output of the cooling device or determine the output of the cooling device according to one of a first method and a second method when the representative temperature of the storage space falls within the convergence temperature range, and determine the output of the cooling device according to the second method when the representative temperature of the storage space is outside the convergence temperature range; and operate the cooling device at the determined output.

Further, according to still another aspect, a refrigerator may include a cabinet having a storage space; a temperature sensor configured to detect a temperature of the storage space; a cooling device configured to operate to cool the storage space; and a controller configured to control the cooling device, wherein the controller may operate the cooling device at a previously-determined output, determine a representative temperature of the storage space based on the temperature measured by the temperature sensor when an output change time is reached in operating the cooling device, determine whether the determined representative temperature of the storage space falls within a convergence temperature range, determine to maintain the output of the cooling device when the representative temperature of the storage space falls within the convergence temperature range, determine the output of the cooling device according to one of a plurality of methods based on a magnitude of a difference value between the representative temperature of the storage space and a set temperature of the storage space when the representative temperature of the storage space is outside the convergence temperature range, and operate the cooling device at the determined output.

The storage space may include a refrigerating space and a freezing space, and the cooling device may be a damper configured to open and close a duct for supplying cold air from the freezing space to the refrigerating space.

The storage space may be the freezing space, and the cooling device may be one or more of a compressor and a fan driving unit.

Advantageous Effects of Invention

According to the present embodiment, the temperature of the storage space may be maintained within the convergence temperature range while the cooling device is continuously operating, thus improving the freshness of an object stored.

In addition, since the cooling device continuously operates, noise may be prevented during the turning-on/off of the cooling device and an increase in power consumption during the turning-on/off of the cooling device may be prevented.

In addition, when the representative temperature of the storage space is out of the convergence temperature range, the representative temperature of the storage space may quickly enter the convergence temperature range.

BRIEF DESCRIPTION OF DRAWINGS

FIG. 1 is a view schematically showing a configuration of a refrigerator according to an embodiment of the present disclosure.

FIG. 2 is a block diagram of a refrigerator of the present disclosure.

FIGS. 3 and 4 are flowcharts showing a method of controlling a refrigerator according to an embodiment of the present disclosure.

FIG. 5 is a graph for describing a change in temperature of a storage space and control of an output of a cooling device according to an embodiment.

FIGS. 6 and 7 are flowcharts showing a method of controlling a refrigerator according to another embodiment of the present disclosure.

MODE FOR THE INVENTION

Hereinafter, some embodiments of the present disclosure will be described in detail with reference to accompanying drawings. In the following description, the same reference numerals will be assigned to the same elements even though the elements are illustrated in different drawings. In addition, in the following description of an embodiment of the present disclosure, a detailed description of well-known features or functions will be ruled out in order not to unnecessarily obscure the gist of the present disclosure.

In the following description of elements according to an embodiment of the present disclosure, the terms 'first', 'second', 'A', 'B', '(a)', and '(b)' may be used. The terms are used only to distinguish relevant elements from other elements, and the nature, the order, or the sequence of the relevant elements is not limited to the terms. When a certain element is liked to, coupled to, or connected with another element, the certain element may be directly linked to or connected with the another element, and a third element may be linked, coupled, or connected between the certain element and the another element.

FIG. 1 is a view schematically illustrating the configuration of the refrigerator according to an embodiment of the present disclosure. FIG. 2 is a block diagram of a refrigerator according to the present disclosure.

Referring to FIGS. 1 and 2, a refrigerator 1 according to an embodiment of the present disclosure may include a cabinet 11 in which a storage space (or storage compartment) is formed and a storage space door coupled to the cabinet 11 to open or close the storage space.

The storage space may include a freezing space 111 and a refrigerating space 112, and the freezing space 111 and the refrigerating space 112 may store an article such as foods.

One of the freezing space 111 and a refrigerating space 112 may be called a first storage space, the other of the freezing space 111 and a refrigerating space 112 may be called a second storage space.

The freezing space 111 and the refrigerating space 112 may be placed left and right or up and down of the inner part of the cabinet 11 by a partition 113.

The partition 113 include a connection duct (not illustrated) for providing a cooling air passage for supplying cooling air to the refrigerating space 112. A damper 12 is installed in the connection fluid passage (not illustrated) to open or close the connection duct.

The refrigerator 1 may further include a cooling cycle 20 to the freezing space 111 and/or the refrigerating space 112.

The cooling cycle 20 may include a compressor 21 to compress a refrigerant, a condenser 22 to condense the refrigerant which has passed through the compressor 21, an expansion member 23 to expand the refrigerant which has passed through the condenser 22, and an evaporator 24 to evaporate the refrigerant which has passed through the expansion member 23. The evaporator 24 may include an evaporator for a freezing space.

The refrigerator 1 may include a fan 26, which allows air to flow toward the evaporator 24 for the circulation of cooling air in the freezing space 111, and a fan driving unit 25 to drive the fan 26.

According to the present embodiment, to supply the cooling air to the freezing space 111, the compressor 21 and the fan driving unit 25 have to be actuated. To supply the cooling air to the refrigerating space 112, not only are the compressor 21 and the fan driving unit 25 actuated, but the damper 12 has to be opened. In this case, the damper 12 may be operated by a damper driving unit 13.

According to the present disclosure, the compressor 21, the fan driving unit 25, and the damper 12 (or a damper driving unit) are collectively named cooling device operating to cool the storage space.

According to the present disclosure, when the cooling device includes the compressor 21 and the fan driving unit 25, the wording that the cooling device operates refers to the compressor 21 and the fan driving unit 25 are turned on, and the wording that the cooling device stops refers to the compressor 21 and the fan driving unit 25 are turned off.

In the present specification, when the cooling device is a compressor 21 and a fan driving unit 25, the output of the cooling device may mean the cooling power of the compressor 21 and the rotational speed of the fan driving unit 25.

When the cooling device includes the damper 12, the wording that the cooling device operates refers to the damper 12 is opened such that cooling air of the freezing space 111 flows into the refrigerating space 112, and the wording that the cooling device stops refers to the damper 12 is closed such that the cooling air of the freezing space 111 does not flow into the refrigerating space 112.

When the cooling device is a damper 12 (or a damper driving unit), the output of the cooling device may mean an opening angle of the damper 12.

The fact that the output of the cooling device is increased may mean that the opening angle of the damper 12 is increased, and the fact that the output of the cooling device is decreased may mean that the opening angle of the damper 12 is decreased.

The refrigerator 1 may include a freezing space temperature sensor 41 to sense the temperature of the freezing space 111, a refrigerating space temperature sensor 42 to sense the temperature of the refrigerating space 112, and a controller 50 (or control unit) to control the cooling device based on the temperatures sensed by the temperature sensors 41 and 42.

The refrigerator 1 may include a freezing space temperature sensor 41 that detects a temperature of the freezing space 111, a refrigerating space temperature sensor 42 that detects a temperature of the refrigerating space 112, and the controller 50 that controls the cooling device based on the temperatures of the temperature sensors 41 and 42.

The controller 50 may control one or more of the compressor 21 and the fan driving unit 25 to maintain the temperature of the freezing space 111 at a set temperature or a temperature close to the set temperature.

For example, the controller 50 may increase, maintain or decrease an output of at least one of the fan driving unit 25 and the compressor 21. The output of the cooling device may also be an output (or output property) of the fan 26 (i.e., the rotational speed of the fan).

The controller 50 may increase, maintain, or decrease an output of at least one of the compressor 21, the fan driving unit 25, and the damper 12 (or the damper driving unit 13) to maintain the temperature of the refrigerating space 111 at a set temperature or a temperature close to the set temperature.

For example, the controller 50 may change an opening angle of the damper 12 while the compressor 21 and the fan driving unit 25 are operating at constant outputs.

The refrigerator may further include a memory 52. A set temperature (or target temperature) may be stored in the memory 52. Further, a temperature of the storage space which is detected by the temperature sensor may be accumulated and stored in the memory 52.

In this specification, hereinafter, the temperature higher than the set temperature (or target temperature) of the refrigerating space 112 is referred to as a first refrigerating space reference temperature, and the temperature lower than the set temperature of the refrigerating space 112 is referred to a second refrigerating space reference temperature.

In addition, hereinafter, the temperature higher than the set temperature of the freezing space 111 is referred to as a first freezing space reference temperature, and the temperature lower than the set temperature of the freezing space 111 is referred to a second freezing space reference temperature.

The range between the first refrigerating space reference temperature and the second refrigerating space reference temperature may be referred to as a temperature satisfying range for the refrigerating space.

The range between the first freezing space reference temperature and the second freezing space reference temperature may be referred to as a temperature satisfying range for the freezing space.

The controller 50 may control the output of the cooling device (or control an operating property of the cooling device) such that the target temperature of the freezing space 111 and/or the refrigerating space 112 is maintained within a temperature satisfaction section.

Hereinafter, a method of controlling a constant temperature of the storage space will be described.

As described above, the storage space may include a refrigerating space or a freezing space, and the method of controlling a constant temperature of the refrigerating space may be to, for example, control an output of a damper, and the method of controlling a constant temperature of a freezing space may be to, for example, control one or more outputs of a compressor and a fan driving unit.

FIGS. 3 and 4 are flowcharts showing a method of controlling a refrigerator according to an exemplary embodiment of the present disclosure, and FIG. 5 is a graph for describing a change in temperature of a storage space and control for an output of a cooling device according to an embodiment.

Referring to FIGS. 3 to 5, when the refrigerator 1 is powered on (S1), the controller 50 may perform a preliminary operation for constant temperature control (S2).

In this specification, the cooling device may be turned on when a temperature of the storage space is higher than or equal to the upper limit temperature (A1) higher than a first reference temperature (C1) and be turned off when a temperature of the storage space is lower than or equal to the lower limit temperature (A2) lower than a second reference temperature (C2).

In general, when the refrigerator 1 is turned on or the cooling device is turned on while the refrigerator 1 is powered off or the cooling device is turned off for defrost, the temperature of the storage space may be higher than the upper limit temperature A1. Accordingly, the controller 50 may control the cooling device so as to operate at a predetermined upper limit output, for example, the maximum output, such that the temperature of the storage space can be rapidly lowered.

For example, the controller 50 may control the compressor 21 to operate with maximum cooling power, and the opening angle of the damper 12 may be maximized.

When the compressor 21 is operated with maximum cooling power or when the opening angle of the damper 12 is maximized, the temperature of the storage space is lowered, and when the temperature of the storage space is less than the lower limit temperature A2, the controller 50 may stop the compressor 21 or close the damper 12.

That is, the preliminary operation may include operating the cooling device at the maximum output and stopping the cooling device.

During the preliminary operation, the controller 50 may determine whether a constant temperature control start condition is satisfied (S3).

For example, the controller 50 may determine whether the temperature of the storage space reaches a set temperature while the cooling device is stopped.

When the cooling device is stopped, the temperature of the storage space may rise, and when the temperature of the storage space reaches the set temperature, the controller 50 may determine that the constant temperature control start condition is satisfied, and perform control for the constant temperature of the storage space.

When the constant temperature control start condition is satisfied, the cooling device may be operated at a predetermined output (lower than the upper limit output) (S4). The predetermined output may be an output between the minimum output and the maximum output.

In the case of the constant temperature control, the cooling device may be operated continuously. In a case where the cooling device is repeatedly turned on or off, noise may be caused when the cooling device is turned on or off, and power consumption may increase when the cooling device is turned on. However, when the cooling device is continuously operated, noise that may occur while the cooling device is turned on/off may be reduced.

In addition, when the output of the cooling device is determined as an appropriate output for controlling the constant temperature of the storage space, power consumption may be reduced compared to a case where the cooling device is repeatedly turned on/off.

The constant temperature control operation may include detecting a temperature of the storage space at unit time intervals (S5), determining an output of the cooling device (S6 to S12), and operating the cooling device at the determined output (S13).

In the present embodiment, the controller 50 may adjust the output of the cooling device to control the constant temperature of the storage space. Specifically, the controller 50 may adjust the output of the cooling device based on a representative temperature of the storage space.

The temperature sensors 41 and 42 may detect the temperature of the storage space at unit time intervals (S5). The detected temperature of the storage space may be stored in the memory 52.

The controller 50 may determine whether the output change time has been reached (S6). The output change time may mean a time until an output of the cooling device is determined again after the output of the cooling device is previously determined. This output change time may be referred to as a sampling time.

When it is determined that the output change time has been reached in step S6, the controller 50 may determine the representative temperature of the storage space and determine whether the representative temperature of the storage space falls within a convergence temperature range (or a temperature satisfaction section) (S7).

That is, the temperature of the storage space is measured by the temperature sensors 41 and 42 at unit time intervals, and each time a sampling time elapses, the controller 50 may determine whether the representative temperature of the storage space falls within the convergence temperature range (or the temperature satisfaction section). The sampling time may be greater than the unit time.

The reason why the controller 50 determines whether the representative temperature of the storage space falls within the convergence temperature range (or temperature satisfaction section) for each sampling time is to prevent frequent determination of the output of the cooling device, and reduce the likelihood that it is erroneously determined that the representative temperature of the storage space is within a convergence temperature range (or a temperature satisfaction section) based on a temperature temporarily and abnormally detected or a temperature detected by a detection error.

The representative temperature of the storage space may be, for example, a temperature of the storage space at a time when the output change time is reached, an average temperature of the storage space before the output change time is reached, an average temperature of the storage space in some of all of sections before the output change time is reached, an average temperature of a highest temperature and a lowest temperature in all of the sections before the output change time is reached, or an average temperature of a highest temperature and a lowest temperature in some of all of the sections before the output change time.

When the temperature of the storage space is used as the representative temperature of the storage space, there is a possibility that an abnormally-detected temperature or a temperature detected by a detection error may be selected instead of a normally-detected temperature. In this case, there is a possibility that the determined output of the cooling device is set excessively high or low, but the current temperature of the storage space may be accurately reflected.

On the other hand, when the average temperature or the intermediate temperature is used as the representative temperature of the storage space, it is unlikely that the determined output will be set excessively high or low, but the current temperature is not accurately reflected and the previous temperature is considered together, and thus there is a possibility that less or more cold air will be supplied than needed.

An absolute value of a difference value between the set temperature and the first reference temperature C1 may be identical to or different from an absolute value of a difference value between the set temperature and the second reference temperature C2.

As a result of the determination in step S7, when the representative temperature of the storage space is out of the convergence temperature range, the controller 50 may determine the output of the cooling device based on at least one of a difference value (first factor) between the representative temperature of the storage space and the set temperature, and a difference value (second factor) between the current representative temperature and the previous representative temperature of the storage space (S8). When the representative temperature of the storage space is out of the convergence temperature range, there are time points T4, T5, T6, T7, T8, and T9 as examples in FIG. 5.

The controller 50 may operate the cooling device at the determined output (S13).

As a first example, when the representative temperature of the storage space is higher than the set temperature, and the absolute value of a difference value between the representative temperature of the storage space and the set temperature is greater than a first reference value (for example, at time T8 in FIG. 5), the controller 50 may determine to increase the output of the cooling device.

When the representative temperature of the storage space is lower than the set temperature, and the absolute value of a difference value between the representative temperature of the storage space and the set temperature is greater than a first reference value (for example, at time T5 in FIG. 5), the controller 50 may determine to decrease the output of the cooling device.

In this case, according to a magnitude of the absolute value of the difference value between the representative temperature of the storage space and the set temperature, the amount of increase or decrease in output of the cooling device may be made different.

When the representative temperature of the storage space is higher than the set temperature, and the absolute value of a difference value between the representative temperature of the storage space and the set temperature is greater than the first reference value and less than a second reference value, the controller 50 may determine to increase the output of the cooling device by a first level. When the representative temperature of the storage space is higher than the set temperature, and the absolute value of a difference value between the representative temperature of the storage space and the set temperature is greater than the second reference value, the controller 50 may determine to increase the output of the cooling device by a second level.

When the representative temperature of the storage space is lower than the set temperature, and the absolute value of a difference value between the representative temperature of the storage space and the set temperature is greater than the first reference value and less than the second reference value, the controller 50 may determine to decrease the output of the cooling device by the first level. When the representative temperature of the storage space is lower than the set temperature, and the absolute value of a difference value between the representative temperature of the storage space and the set temperature is greater than the second reference value, the controller 50 may determine to decrease the output of the cooling device by the second level.

As a second example, when the representative temperature of the storage space is higher than the set temperature, and a difference value between the representative temperature and a previous representative temperature of the storage space is greater than zero, the controller 50 may determine to increase the output of the cooling device.

When the representative temperature of the storage space is higher than the set temperature and the difference value between a current representative temperature of the storage space and the previous representative temperature is less than zero, it may be possible to determine whether or not to increase the output of the cooling device according to the absolute value of the difference value between the current representative temperature and the previous representative temperature of the storage space. When the absolute value of the difference value between the representative temperature and the previous representative temperature of the storage space is greater than a third reference value, the controller 50 may determine to maintain the output of the cooling device. When the decrease rate of the representative temperature of the storage space is fast although the representative temperature of the storage space is higher than the first reference temperature C1, the controller 50 may determine to maintain the output of the cooling device.

On the other hand, when the absolute value of the difference value between the representative temperature and the previous representative temperature of the storage space is less than the third reference value, the controller 50 may determine to increase the output of the cooling device. In a state in which the representative temperature of the storage space is higher than the first reference temperature C1, when the decrease rate of the representative temperature of the storage space is slow, the controller 50 may determine to increase the output of the cooling device.

Alternatively, when the representative temperature of the storage space is lower than the set temperature, and a difference value between the representative temperature of the storage space and a previous representative temperature is less than zero, the controller 50 may determine to decrease the output of the cooling device.

When the representative temperature of the storage space is lower than the set temperature and the difference value between a current representative temperature of the storage space and the previous representative temperature is greater than zero, it may be possible to determine whether or not to increase the output of the cooling device according to the absolute value of the difference value between the current representative temperature of the storage space and the previous representative temperature.

When the absolute value of the difference value between the representative temperature and the previous representative temperature of the storage space is greater than a fourth reference value, the controller 50 may determine to maintain the output of the cooling device. When the increase rate of the representative temperature of the storage space is fast although the representative temperature of the storage space is lower than a second reference temperature C2, the controller 50 may determine to maintain the output of the cooling device.

On the other hand, when the absolute value of the difference value between the representative temperature and the previous representative temperature of the storage space is less than the fourth reference value, the controller 50 may determine to decrease the output of the cooling device. In a state in which the representative temperature of the storage space is lower than the second reference temperature C2, when the increase rate of the representative temperature of the storage space is slow, the controller 50 may determine to decrease the output of the cooling device.

As a third example, the controller may determine the output of the cooling device by taking into account a first factor and a second factor together.

For example, when the controller determines to increase the output of the cooling device based on the first factor and to increase the output of the cooling device based on the second factor, the output of the cooling device may be finally increased.

When the controller determines to increase the output of the cooling device based on the first factor and to maintain the output of the cooling device based on the second factor, the output of the cooling device may be finally increased.

When the controller determines to decrease the output of the cooling device based on the first factor and to decrease the output of the cooling device based on the second factor, the output of the cooling device may be finally decreased.

When the controller determines to decrease the output of the cooling device based on the first factor and to maintain the output of the cooling device based on the second factor, the output of the cooling device may be finally decreased.

When the controller determines to decrease the output of the cooling device based on the first factor and to increase the output of the cooling device based on the second factor, the output of the cooling device may be finally maintained, increased or decreased based on the magnitude of a decreased output determined based on the first factor and on the magnitude of an increased output determined based on the second factor.

When the controller determines to increase the output of the cooling device based on the first factor and to decrease the output of the cooling device based on the second factor, the output of the cooling device may be finally maintained, increased or decreased based on the magnitude of an increased output determined based on the first factor and on the magnitude of a decreased output determined based on the second factor.

Meanwhile, as a result of the determination in step S7, when the representative temperature of the storage space falls within the convergence temperature range, the controller 50 may determine whether the representative temperature of the storage space is converging (S9).

When the representative temperature of the storage space falls within the convergence temperature range, there are time points T2, T3, T10, T11, T12, T13, and T14 as examples in FIG. 5.

In this embodiment, a case where the representative temperature of the storage space is converging may include one or more of a first case where a time for which the representative temperature of the storage space is continuously maintained within the convergence temperature range is greater than or equal to a first reference time, a second case where a number of times the representative temperature of the storage space has fallen within the convergence temperature range is greater than or equal to a first reference number N when determining whether the representative temperature of the storage space falls within the convergence temperature range for each sampling time, a third case where an accumulated time for which the representative temperature of the storage space is continuously maintained within the convergence temperature range is greater than or equal to a second reference time, or a fourth case where a number of times the representative temperature of the storage space has reached a set temperature of the storage space is greater than or equal to a second reference number M.

In the first case, at time point T13 as an example in FIG. 5, it may be determined that the representative temperature of the storage space is converging.

In the second case, at time point T12 as an example in FIG. 5, it may be determined that the representative temperature of the storage space is converging.

In the third case, at time point T11 as an example in FIG. 5, it may be determined that the representative temperature of the storage space is converging.

In the fourth case, at time point T12 as an example in FIG. 5, it may be determined that the representative temperature of the storage space is converging.

When the representative temperature of the storage space is converging, the representative temperature of the storage space may be maintained or almost maintained within the convergence temperature range.

Accordingly, when the representative temperature of the storage space is converging, the controller 50 may determine to maintain the output of the cooling device (S12). The controller 50 may operate the cooling device at the determined output (S13). That is, the controller 50 may determine a current output as the output of the previous cooling device and operate the cooling device at the determined output.

Even when the output of the cooling device is maintained, there is a high possibility that the representative temperature of the storage space is maintained within convergence temperature range.

On the other hand, when it is determined that the representative temperature of the storage room is not converging as a result of the determination in step S9, the controller 50 may determine whether or not a convergence criterion is satisfied (S10).

The case where the convergence criterion is satisfied may be a case where the representative temperature of the storage space is not converging, but the change pattern of the representative temperature of the storage space has a pattern capable of convergence.

For example, the case where the convergence criterion is satisfied may be a case where a time for which the representative temperature of the storage space is continuously maintained within the convergence temperature range is less than the first reference time and greater than or equal to a third reference time shorter than the first reference time. In FIG. 5, as an example, it may be determined that the convergence criterion is satisfied at time point T11.

Alternatively, the case where the convergence criterion is satisfied may be a case where a number of times the representative temperature of the storage space has fallen within the convergence temperature range is less than the first reference number (N) and greater than or equal to a third reference number (X) less than the first reference number (N) when determining whether the representative temperature of the storage space falls within the convergence temperature range for each sampling time. In FIG. 5, as an example, it may be determined that the convergence criterion is satisfied at time point T10.

Alternatively, the case where the convergence criterion is satisfied may be a case where an accumulated time for which the temperature of the storage space is maintained within the convergence temperature range is less than the second reference time and is greater than or equal to a fourth reference time shorter than the second reference time. In FIG. 5, as an example, it may be determined that the convergence criterion is satisfied at time point T10.

Alternatively, the case where the convergence criterion is satisfied may be a case where the number of times the representative temperature of the storage space has reached the set temperature is less than the second reference number M and greater than or equal to a fourth reference number Y. In FIG. 5, as an example, it may be determined that the convergence criterion is satisfied at time point T11.

When it is determined that the convergence criterion is not satisfied as a result of the determination in step S10, the controller 50 may determine the output of the cooling device based on one or more of a difference value (first factor) between the representative temperature of the storage space and the set temperature and a difference value (second factor) between a current representative temperature and a previous representative temperature of the storage space (S8).

On the other hand, when it is determined that the convergence criterion is satisfied as the result of the determination in step S10, the controller 50 may determine the output of the cooling device based on the previous output of the cooling device (S11).

For example, the controller 50 may determine a value (a×(maximum value+minimum value)) obtained by multiplying a sum of a maximum value and a minimum value of the output of the cooling device by "a" as the output of the cooling device, at a time when the representative temperature of the storage space is maintained within the convergent temperature range. "a" may have a value greater than zero and less than 1.

Although not limited, "a" may be 0.5. In this case, the output of the cooling device may be an average value of the maximum value and the minimum value.

The controller 50 may operate the cooling device at the determined output (S13).

As in the present embodiment, when the representative temperature of the storage space satisfies the convergence criterion, it may be possible to minimize a possibility that the representative temperature of the cooling device is out of the convergence temperature range due to a change in output of the cooling device when the output of the cooling device is determined based on the previous output of the cooling device.

That is, when the representative temperature of the storage space has a pattern capable of convergence, it may be highly likely that the outputs of the cooling device previously determined are desirable outputs for maintaining the representative temperature of the storage space within the convergence temperature range. Therefore, when the output of the cooling device is determined based on information on the output of the cooling device at a time when the representative temperature of the storage space is maintained within the convergent temperature range, it may be a high possibility that the representative temperature of the storage space is maintained within the convergence temperature range when the cooling device is operated at the determined output.

Unless the refrigerator 1 is powered off (S14), the controller 50 may repeatedly perform a step of determining the output of the cooling device (S6 to S12), and a step of operating the cooling device at the determined output (S13).

As another example, as a result of the determination in step S6, when the representative temperature of the storage space is within the convergent temperature range, the controller 50 may determine the output of the cooling device based on the previous output of the cooling device as in step S11. In this case, steps S9, S10 and S12 may be omitted. That is, step S9, step S11, and step S13 may be sequentially performed.

As another example, as a result of the determination in step S6, it is possible to determine to maintain the output of the cooling device when the representative temperature of the storage space falls within the convergence temperature range. In this case, step S9 to step S11 may be omitted.

On the other hand, as a result of determination in step S7, when the representative temperature of the storage space is out of the convergence temperature range, the output of the cooling device may be determined by a method described in step S8. In the present specification, step S8 may be referred to as a variable control step in which the output of the cooling device can vary.

However, when the representative temperature of the storage space is higher than or equal to the upper limit temperature A1, which is higher than the first reference temperature C1 (for example, when a door is opened, when heat having a temperature higher than the temperature of the storage space is supplied to the storage space, when defrosting operation is performed, or the like), the representative temperature of the storage space may need to be quickly lowered. Therefore, when the representative temperature of the storage space is higher than or equal to the upper limit temperature A1, the variable control step may be not performed. In this case, the controller 50 may allow the cooling device to operate at the maximum output. Even while the cooling device is operating at the maximum output, the temperature of the storage space may be measured by the temperature sensor and a representative temperature of the storage space may be determined.

When the representative temperature of the storage space falls within the convergence temperature range while the cooling device is operating at the maximum output, steps after step S7 may be performed.

In addition, when the representative temperature of the storage space is lower than or equal to the lower limit temperature A2, which is lower than the second reference temperature C2 (for example, when cold air having a temperature lower than the temperature of the storage space is supplied to the storage space, when defrosting operation is performed, or the like), the representative temperature of the storage space may need to be quickly raised. Therefore, when the representative temperature of the storage space is lower than or equal to the lower limit temperature A2, the variable control step may be not performed. In this case, the controller 50 may allow the cooling device to operate at the minimum output. Even while the cooling device is operating at the minimum output, the temperature of the storage space may be measured by the temperature sensor and a representative temperature of the storage space may be determined. When the representative temperature of the storage space falls within the convergence temperature range while the cooling device is operating at the minimum output, steps after step S7 may be performed.

According to the present embodiment, the temperature of the storage space may be maintained within the convergence temperature range while the cooling device is continuously operating, thus improving the freshness of an object stored.

In addition, since the cooling device continuously operates, noise may be prevented during the turning-on/off of the cooling device and an increase in power consumption during the turning-on/off of the cooling device may be prevented.

In addition, when the representative temperature of the storage space is out of the convergence temperature range, the representative temperature of the storage space may quickly enter the convergence temperature range.

FIGS. 6 and 7 are flowcharts showing a method of controlling a refrigerator according to another embodiment of the present disclosure.

The present embodiment is substantially identical to the above-described embodiments, except for steps after step S7 in FIGS. 3 and 4. Therefore, hereinafter, only characteristic parts of the present embodiment will be described.

Referring to FIGS. 6 and 7, after performing steps S1 to S6, the controller 50 may determine whether the representative temperature of the storage space falls within a convergence temperature range (or a temperature satisfaction section) (S7).

When the representative temperature of the storage space falls within the convergence temperature range as a result of determination in step S7, the controller 50 may determine to maintain the output of the cooling device (S12). The controller 50 may operate the cooling device at the determined output (S13).

On the other hand, when the representative temperature of the storage space is out of the convergence temperature range as a result of the determination in step S7, the controller 50 may select one of two methods to determine the output of the cooling device according to the magnitude of the absolute value of a difference value between the set temperature and the representative temperature of the storage space.

For example, the controller 50 may determine whether the magnitude of the absolute value of the difference value between the set temperature and the representative temperature of the storage space is less than or equal to a reference value (S21).

The absolute value of the reference value may be greater than the absolute values of the reference temperatures C1 and C2 and less than the absolute values of the upper limit temperature A1 and the lower limit temperature A2.

When the magnitude of the absolute value of the difference value between the set temperature and the representative temperature of the storage space is less than or equal to the reference value as a result of the determination in step S21, the controller 50 may determines the output of the cooling device based on a previous output of the previous cooling device (S22).

Since step S22 is identical to step S11 of FIG. 5 described in the previous embodiment, a detailed description for determination of the output of the cooling device based on the output of the cooling device will be omitted.

When the magnitude of the absolute value of the difference value between the set temperature and the representative temperature of the storage space is greater than the reference value as a result of the determination in step S21, the controller 50 may determine the output of the cooling device based on one or more of a difference value (first factor) between the representative temperature of the storage space and the set temperature and a difference value (second factor) between a current representative temperature and a previous representative temperature of the storage space (S23).

Since step S24 is identical to step S8 of FIG. 5 described in the previous embodiment, a detailed description for determination of the output of the cooling device will be omitted.

In this embodiment, when the magnitude of the absolute value of the difference value between the set temperature and the representative temperature of the storage space is less than the reference value, it is possible to enable the representative temperature of the storage space to fall within the convergence temperature range by reducing a variation width of the output of the cooling device.

In addition, when the magnitude of the absolute value of the difference value between the set temperature and the representative temperature of the storage space is greater than the reference value, it is possible to quick raise or lower the representative temperature of the storage space by increasing a variation width of the output of the cooling device.

In this specification, a method of determining the output of the cooling device in step S11 of FIG. 5 and step S22 of FIG. 7 may be called a first method, and a method of determining the output of the cooling device in step S8 of FIG. 5 and step S23 of FIG. 7 may be called a second method. In addition, a method of determining the output of the cooling device may be added.

Therefore, the output of the cooling device may be determined according to one of a plurality of methods including a first method and a second method, and when the representative temperature of the storage space is outside the convergence temperature range, determining the output of the cooling device according to the second method. On the other hand, when the representative temperature of the storage space is out of the convergence temperature range, the output of the cooling device may be determined according to the second method.

The invention claimed is:

1. A method for controlling a refrigerator having a storage space and a cooling device to cool the storage space, comprising:

operating the cooling device at a determined output for cooling the storage space;

determining, by a temperature sensor, a temperature of the storage space at unit time intervals while the cooling device is operating;

determining a representative temperature of the storage space based on the temperature determined by the temperature sensor, and determining whether the determined representative temperature of the storage space is within a convergence temperature range, at a sampling time after the operating of the cooling device at the determined output;

maintaining the output of the cooling device or determining the output of the cooling device according to one of a plurality of methods including a first method and a second method when the representative temperature of the storage space is determined to be within the convergence temperature range, and determining the output of the cooling device according to the second method when the representative temperature of the storage space is determined to be out of the convergence temperature range; and operating the cooling device at the determined output of the cooling device, wherein the representative temperature of the storage space is determined to be converging when the representative temperature of the storage space is determined to be within the convergence temperature range, and the output of the cooling device can be determined based on the first method when the representative temperature of the storage space is determined to be converging.

2. The method of claim 1, wherein the representative temperature of the storage space corresponds to:

a temperature of the storage space when the sampling time is reached, an average temperature of the storage space before the sampling time is reached, an average temperature of the storage space in some of all sections of the storage space before the sampling time is reached, an average temperature of a highest temperature and a lowest temperature in all of the sections of the storage space before the sampling time is reached, or an average temperature of a highest temperature and a lowest temperature in some of all of the sections of the storage space before the sampling time.

3. The method of claim 1, further comprising:

maintaining the output of the cooling device when the representative temperature of the storage space is determined to be converging.

4. The method of claim 1, further comprising:

determining whether the representative temperature of the storage space satisfies a convergence criterion when the representative temperature of the storage space is determined to not be converging;

determining the output of the cooling device based on the first method when the representative temperature of the storage space is determined to satisfy the convergence criterion; and determining the output of the cooling device based on the second method when the representative temperature of the storage space is determined to not satisfy the convergence criterion.

5. The method of claim 4, wherein an example where the representative temperature of the storage space is converging includes:

a first example in which the representative temperature of the storage space is continuously maintained within the convergence temperature range is greater than or equal to a first reference time, a second example where a number of times the representative temperature of the storage space has fallen within the convergence temperature range is greater than or equal to a first reference number (N) when determining whether the representative temperature of the storage space is within the convergence temperature range at each sampling time, a third example where an accumulated time in which the representative temperature of the storage space is continuously maintained within the convergence temperature range is greater than or equal to a second reference time, or a fourth example in which a number of times the representative temperature of the storage space has reached a set temperature of the storage space is greater than or equal to a second reference number (M).

6. The method of claim 5, wherein the example in which the representative temperature of the storage space satisfies the convergence criterion includes:

an example in which a time for which the representative temperature of the storage space is continuously maintained within the convergence temperature range is less than the first reference time and greater than or equal to a third reference time shorter than the first reference time, an example in which a number of times the representative temperature of the storage space has fallen within the convergence temperature range is less than the first reference number (N) and greater than or equal to a third reference number (X) less than the first reference number (N) when determining whether the representative temperature of the storage space is within the convergence temperature range at each sampling time, an example in which the time for which the representative temperature of the storage space is continuously maintained within the convergence temperature range is less than the second reference time and greater than or equal to a fourth reference time shorter than the second reference time, and an example in which the number of times the representative temperature of the storage space has reached the set temperature is less than the second reference number (M) and greater than or equal to a fourth reference number (Y).

7. The method of claim 1, wherein the determining of the output of the cooling device is based on a previous output of the cooling device.

8. The method of claim 7, further comprising:

determining the output of the cooling device by multiplying a sum of a maximum value and a minimum value of the output of the cooling device by "a" . . . , when the representative temperature of the storage space is maintained within the convergence temperature range.

9. The method of claim 1, wherein the determining of the output of the cooling device when the representative temperature of the storage space is determined to be out of the convergence temperature range is based on one or more of a first factor which is a difference value between the representative temperature of the storage space and the set temperature, and a second factor which is a difference value between a current representative temperature and a previous representative temperature of the storage space.

10. The method of claim 1, wherein the convergence temperature range is a range between a first reference temperature, which is higher than a set temperature of the storage space, and a second reference temperature, which is lower than the set temperature of the storage space.

11. The method of claim 10, further comprising:

determining the output of the cooling device to be a maximum output when the representative temperature of the storage space is higher than or equal to an upper limit temperature which is higher than the first reference temperature.

12. The method of claim 10, further comprising:

determining the output of the cooling device to be a minimum output when the representative temperature of the storage space is less than or equal to a lower limit temperature which is less than the second reference temperature.

13. The method of claim 1, wherein the cooling device is one or more of a compressor, a fan driving device, and a damper that opens and closes a duct.

14. A method for controlling a refrigerator having a storage space and a cooling device to cool the storage space, comprising:

operating the cooling device at a determined output for cooling the storage space;

determining, by a temperature sensor, a temperature of the storage space at unit time intervals;

determining a representative temperature of the storage space based on the determined temperature by the temperature sensor, and determining whether the determined representative temperature of the storage space is within a convergence temperature range, when a sampling time is reached after the operating of the cooling device at the determined output;

determining to maintain the output of the cooling device when the representative temperature of the storage space is determined to be within the convergence temperature range, or determining the output of the cooling device based on a magnitude of a difference value between the representative temperature of the storage space and a set temperature of the storage space when the representative temperature of the storage space is determined to be out of the convergence temperature range; and operating the cooling device at the determined output of the cooling device, wherein the determining of the output of the cooling device is based on a previous output of the cooling device when the difference value between the representative temperature of the storage space and the set temperature of the storage space is less than or equal to a reference value, and wherein the determining of the output of the cooling device is based on one or more of a first factor which is a difference value between the representative temperature of the storage space and the set temperature, and a second factor which is a difference value between a current representative temperature and a previous representative temperature of the storage space when the difference value between the representative temperature of the storage space and the set temperature of the storage space is greater than the reference value.

15. The method of claim 14, wherein the convergence temperature range is a range between a first reference temperature, which is higher than the set temperature of the storage space, and a second reference temperature which is less than the set temperature of the storage space.

16. The method of claim 14, wherein the representative temperature of the storage space corresponds to:

a temperature of the storage space when the sampling time is reached, an average temperature of the storage space before the sampling time is reached, an average temperature of the storage space in some of all sections of the storage space before the sampling time is reached, an average temperature of a highest temperature and a lowest temperature in all of the sections of the storage space before the sampling time is reached, or an average temperature of a highest temperature and a lowest temperature in some of all of the sections of the storage space before the sampling time is reached.

17. A method for controlling a refrigerator having a storage space and a cooling device to cool the storage space, comprising:

operating the cooling device at a determined output for cooling the storage space;

determining a temperature of the storage space at unit time intervals while the cooling device is operating;

determining a representative temperature of the storage space based on the determined temperature of the storage space, and determining whether the determined representative temperature of the storage space is within a convergence temperature range, at each sampling time after the operating of the cooling device;

determining the output of the cooling device when the representative temperature of the storage space is determined to be out of the convergence temperature range, wherein the determining of the output of the cooling device is based on at least one of a difference value between the representative temperature of the storage space and a set temperature of the storage space, a difference value between a current representative temperature and a previous representative temperature of the storage space, or a previous output of the cooling device; and controlling the cooling device to operate at the determined output of the cooling device, wherein the determining of the output of the cooling device is based on the previous output of the cooling device when the difference value between the representative temperature of the storage space and the set temperature of the storage space is less than or equal to a reference value.

18. The method of claim 17, further comprising maintaining the output of the cooling device when the representative temperature of the storage space is determined to be within the convergence temperature range.

19. The method of claim 17, wherein the determining of the output of the cooling device is based on at least one of the difference value between the representative temperature of the storage space and the set temperature of the storage space, or the difference value between the current representative temperature and the previous representative temperature of the storage space when the difference value between the representative temperature of the storage space and the set temperature of the storage space is greater than the reference value.

* * * * *